US009581317B2

(12) United States Patent
Meyer et al.

(10) Patent No.: US 9,581,317 B2
(45) Date of Patent: Feb. 28, 2017

(54) ARRAY HOLDER AND LED MODULE WITH SAME

(71) Applicant: Molex, LLC, Lisle, IL (US)

(72) Inventors: Gregory P. Meyer, Elk Grove Village, IL (US); Daniel B. McGowan, Glen Ellyn, IL (US)

(73) Assignee: Molex, LLC, Lisle, IL (US)

( * ) Notice: Subject to any disclaimer, the term of this patent is extended or adjusted under 35 U.S.C. 154(b) by 68 days.

(21) Appl. No.: 14/382,438

(22) PCT Filed: Mar. 4, 2013

(86) PCT No.: PCT/US2013/028890
§ 371 (c)(1),
(2) Date: Sep. 2, 2014

(87) PCT Pub. No.: WO2013/131092
PCT Pub. Date: Sep. 6, 2013

(65) Prior Publication Data

US 2015/0131299 A1 May 14, 2015

Related U.S. Application Data

(60) Provisional application No. 61/606,069, filed on Mar. 2, 2012.

(51) Int. Cl.
*F21V 21/088* (2006.01)
*F21V 19/00* (2006.01)
(Continued)

(52) U.S. Cl.
CPC ..... *F21V 19/0025* (2013.01); *F21K 9/20* (2016.08); *F21V 17/10* (2013.01); *F21V 19/004* (2013.01);
(Continued)

(58) Field of Classification Search
CPC . F21K 9/30; F21V 17/10; F21V 17/14; F21V 17/16; F21V 19/0025; F21V 19/004;
(Continued)

(56) References Cited

U.S. PATENT DOCUMENTS 7,540,761 B2 * 6/2009 Weber ..... F21V 23/06 313/317
8,807,793 B2 * 8/2014 Schroll ..... F21V 19/002 362/249.02
(Continued)

FOREIGN PATENT DOCUMENTS

JP 2008-193046 A 8/2008
JP 2008-258233 A 10/2008
(Continued)

OTHER PUBLICATIONS

International Search Report for PCT/US2013/028890, Feb. 9, 2014.

*Primary Examiner* — Peggy Neils
(74) *Attorney, Agent, or Firm* — Jeffrey K. Jacobs

(57) ABSTRACT

A holder is configured to support an LED array and includes terminals that have an insulation displacement portion (IDP) and contacts to electrically connect to the LED array. An LED module can be provided that supports a holder and an LED array. The LED module includes a housing with a floor and a wall that extends from the floor to define a first enclosure that receives the holder and LED array. The floor includes one or more channels that allow insulated conductors to extend through the floor and engage the IDP so as to provide power to the LED array.

11 Claims, 16 Drawing Sheets

(51) Int. Cl.

| | |
|---|---|
| ***F21V 17/10*** | (2006.01) |
| ***F21V 21/002*** | (2006.01) |
| ***F21V 29/507*** | (2015.01) |
| *H01R 12/71* | (2011.01) |
| *H01R 12/75* | (2011.01) |
| *F21Y 101/00* | (2016.01) |

(52) U.S. Cl.
CPC ..... *F21V 21/002* (2013.01); *F21V 29/507* (2015.01); *F21Y 2101/00* (2013.01); *H01R 12/714* (2013.01); *H01R 12/75* (2013.01)

(58) Field of Classification Search
CPC .. F21V 19/0045; F21V 21/002; F21V 29/507; F21Y 2101/02; H01R 12/714; H01R 12/75
See application file for complete search history.

(56) References Cited

U.S. PATENT DOCUMENTS 9,146,027 B2 * 9/2015 Zantout ..... F21V 21/088
2006/0245215 A1 11/2006 Tufano et al.
2008/0144320 A1 * 6/2008 Tokunaga ..... F21V 19/0025 362/294
2009/0103291 A1 * 4/2009 Jarzac ..... F21L 4/027 362/200
2009/0191725 A1 * 7/2009 Vogt ..... H01R 4/4818 439/56
2011/0136374 A1 6/2011 Mostoller et al.
2012/0020086 A1 * 1/2012 Kataoka ..... F21V 5/04 362/249.02
2012/0264326 A1 10/2012 Kudo et al.
2013/0122729 A1 * 5/2013 Daily ..... F21V 19/003 439/220

FOREIGN PATENT DOCUMENTS

JP 2010-016003 A 1/2010
JP 2011-249285 A 12/2011

* cited by examiner

ARRAY HOLDER AND LED MODULE WITH SAME

RELATED APPLICATIONS

This application claims priority to U.S. Provisional Application No. 61/606,069, filed Mar. 2, 2012, which is incorporated herein by reference in its entirety.

FIELD OF THE INVENTION

The present invention relates to field of holders, more specifically to the field of holders suitable for supporting an array of LEDs.

DESCRIPTION OF RELATED ART

Light emitting diode (LED) designs have become increasing interesting as technology matures. Initially the costs and performance of LEDs made it difficult for general consumers to consider LEDs particularly attractive. However, as the performance and price have improved, the volume of LED use has beam to increase. At the same time, there has been a trend for the LEDs used (the LEDs are often in an array) to become smaller. Consequentially, one issue that has begun to present itself is that the handling of LEDs has become problematic as the volumes increase. Consequentially, certain individuals would appreciate further improvements in systems and configurations that would add in the handling of LED, particularly compact LED arrays.

BRIEF SUMMARY

A holder is provided. The holder includes a base that supports two terminals, each configured to provide an insulation displacement portion (IDP) for engaging two insulated conductors while the terminals also include contacts that are configured to engage surface contacts on an LED array. The holder is configured to secure an LED array in position and can include a fastener mounts. An LED module can be provided that includes a housing that receives the holder and the LED array. The housing includes a floor, a wall that extends from the wall, wherein the floor and wall define an open cylinder-like shape that allows light emitted from the LED array to be directed in a desired manner. The floor includes apertures that allow insulated conductors to extend through the floor and provide power to the LED array. The housing can be formed of a thermally conductive material such as aluminum and the base can include a lip that extends through the apertures to help provide electrical isolation between the housing and the LED array. A benefit of this design is that the holder allows for a compact LED module and helps provide a cost-effective manufacturing process.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
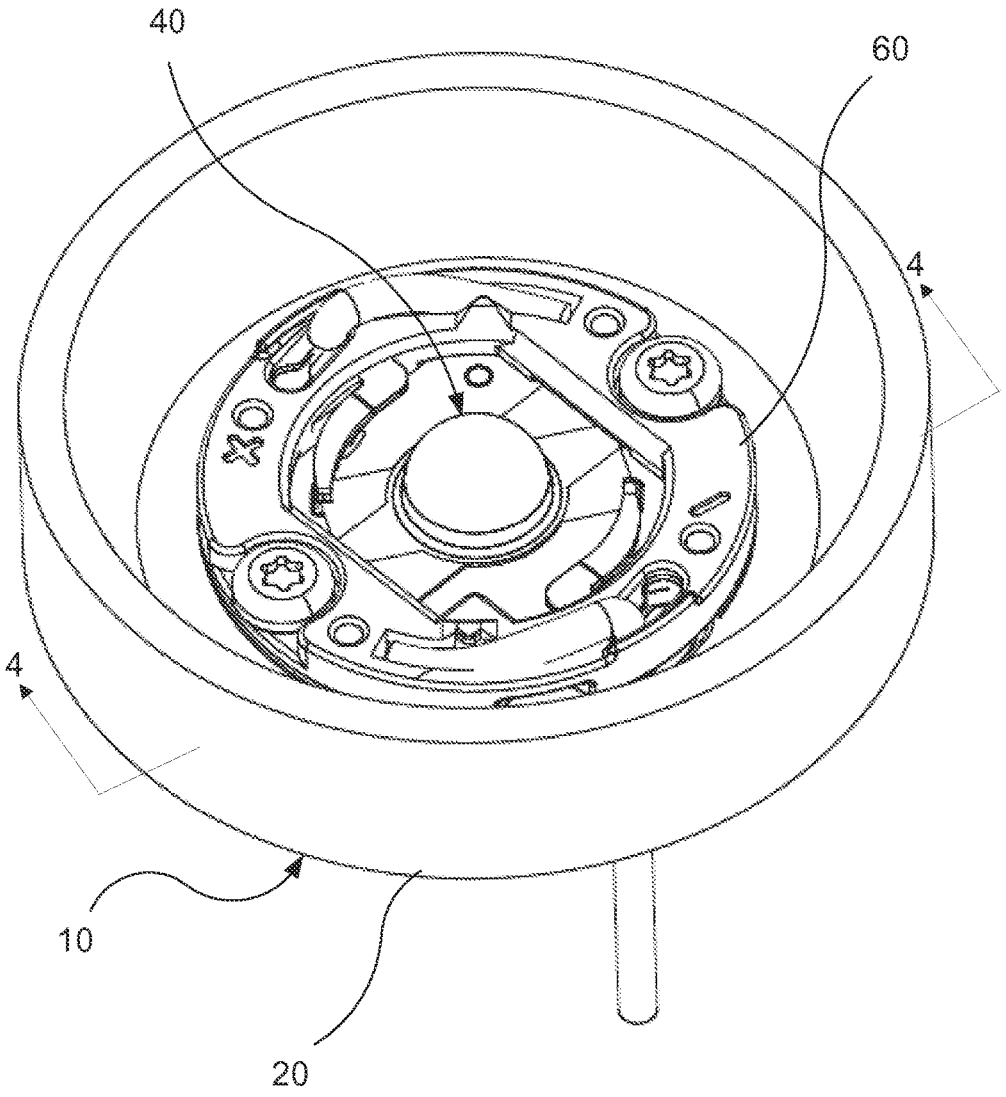
FIG. 1 illustrates a perspective view of an exemplary embodiment of an LED module.
Figure 2:
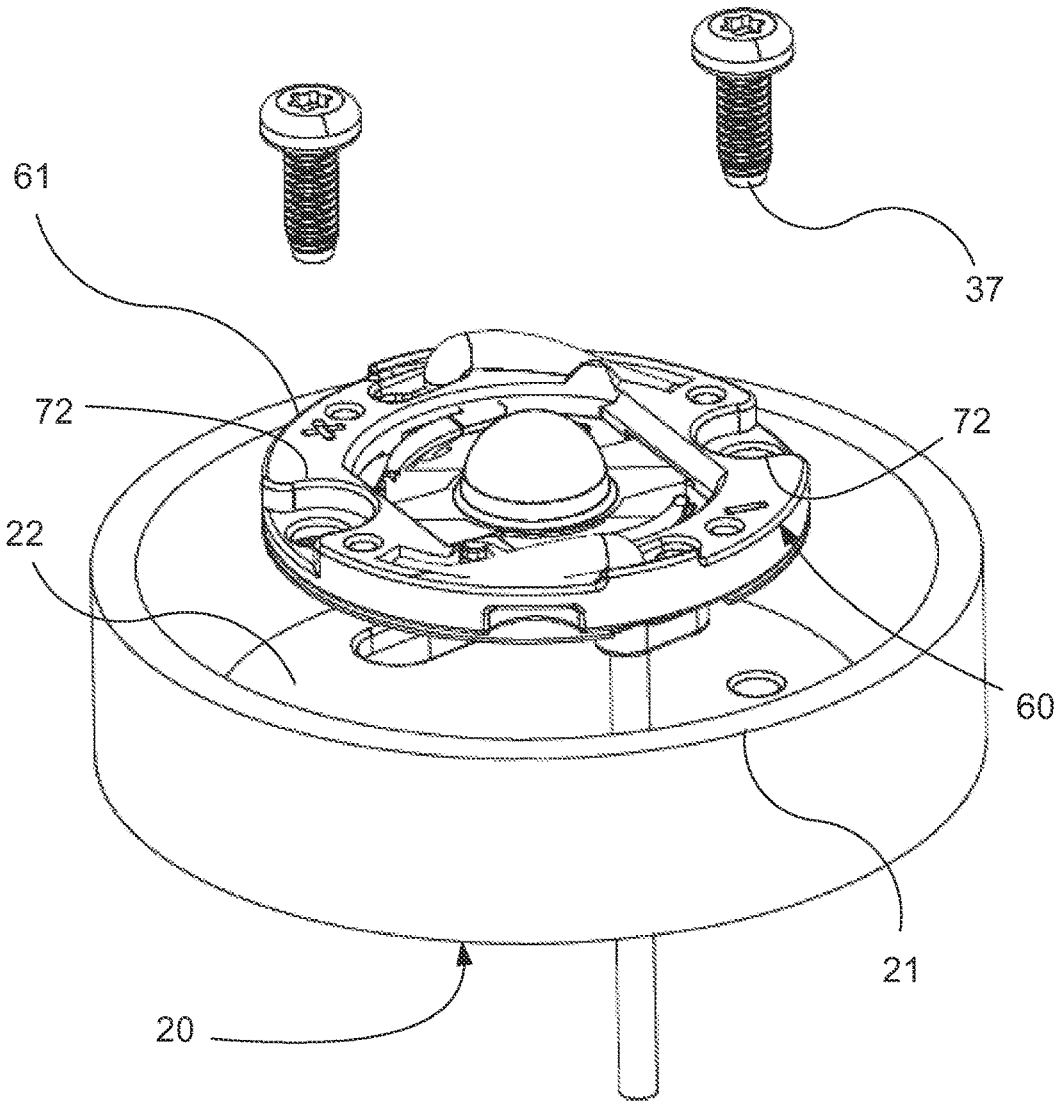
FIG. 2 illustrates a perspective partially exploded view of the embodiment depicted in FIG. 1.
Figure 3:
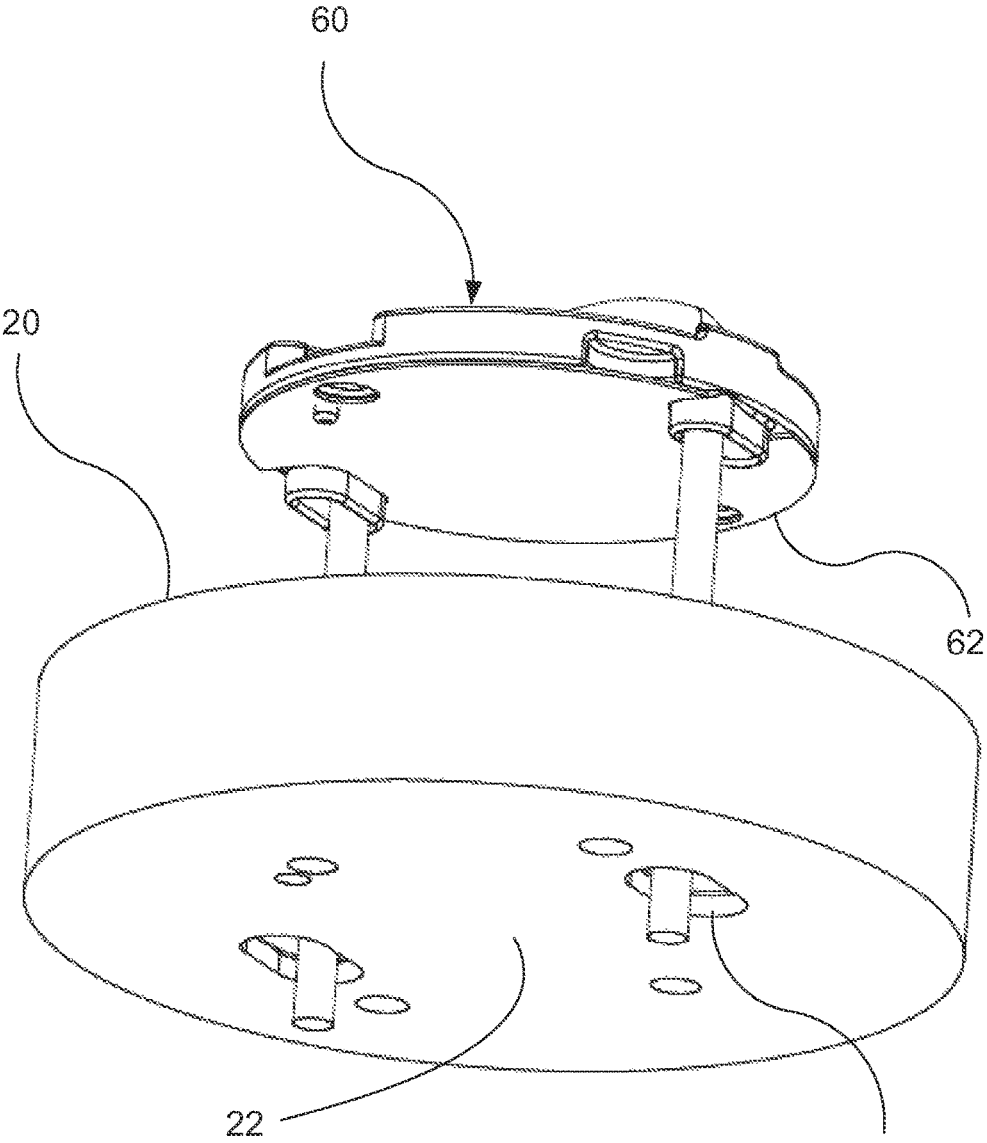
FIG. 3 illustrates a partially exploded view of the embodiment depicted in FIG. 1.
Figure 4:
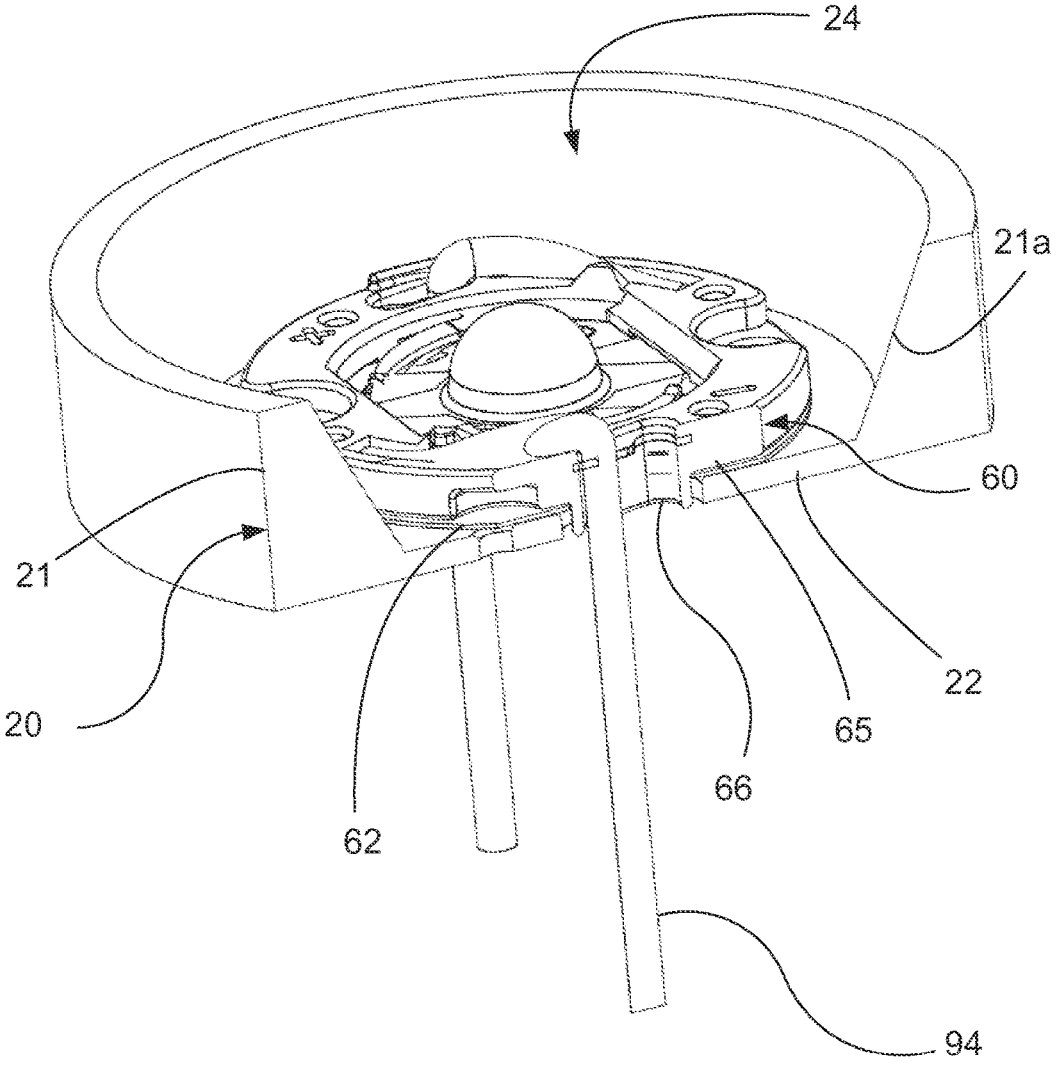
FIG. 4 illustrates a perspective view of a cross-section of the embodiment depicted in FIG. 1 take along line 4-4.
Figure 5:
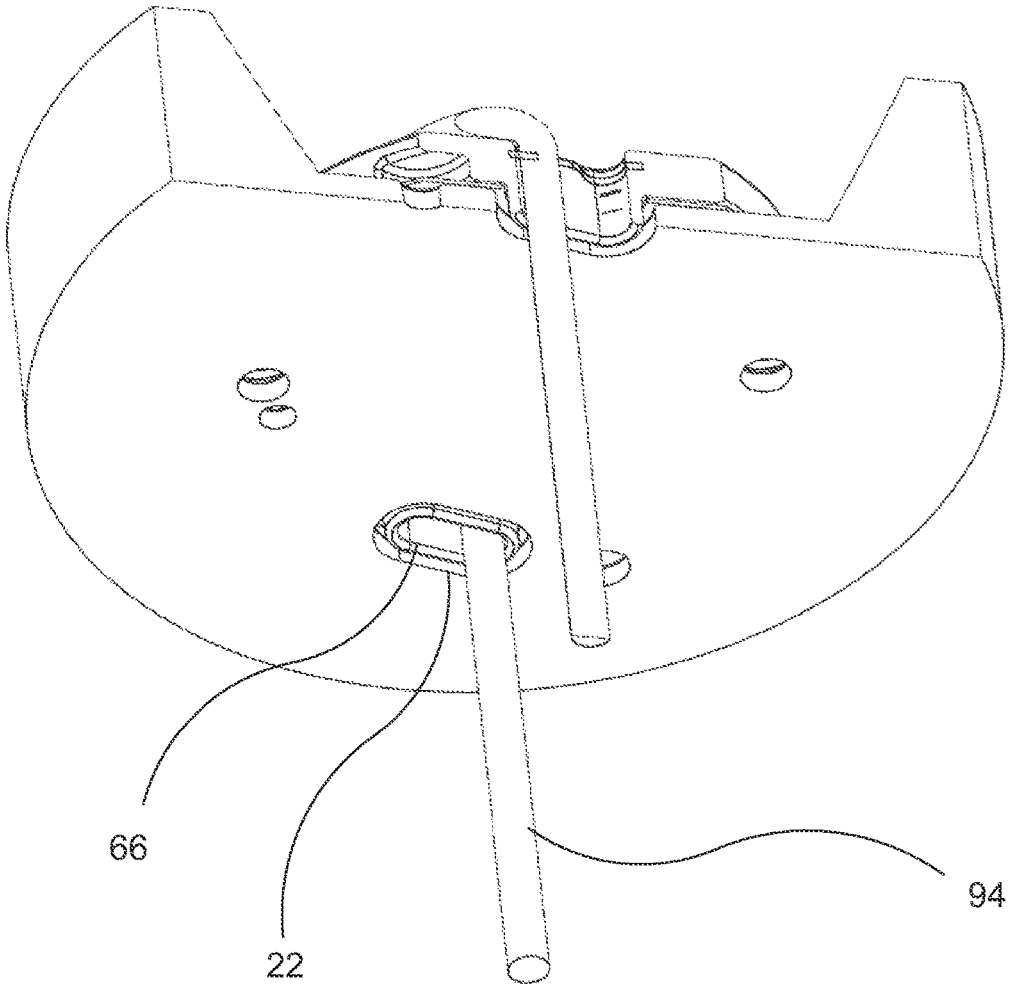
FIG. 5 illustrates another perspective view of the cross-section depicted in FIG. 4.
Figure 6:
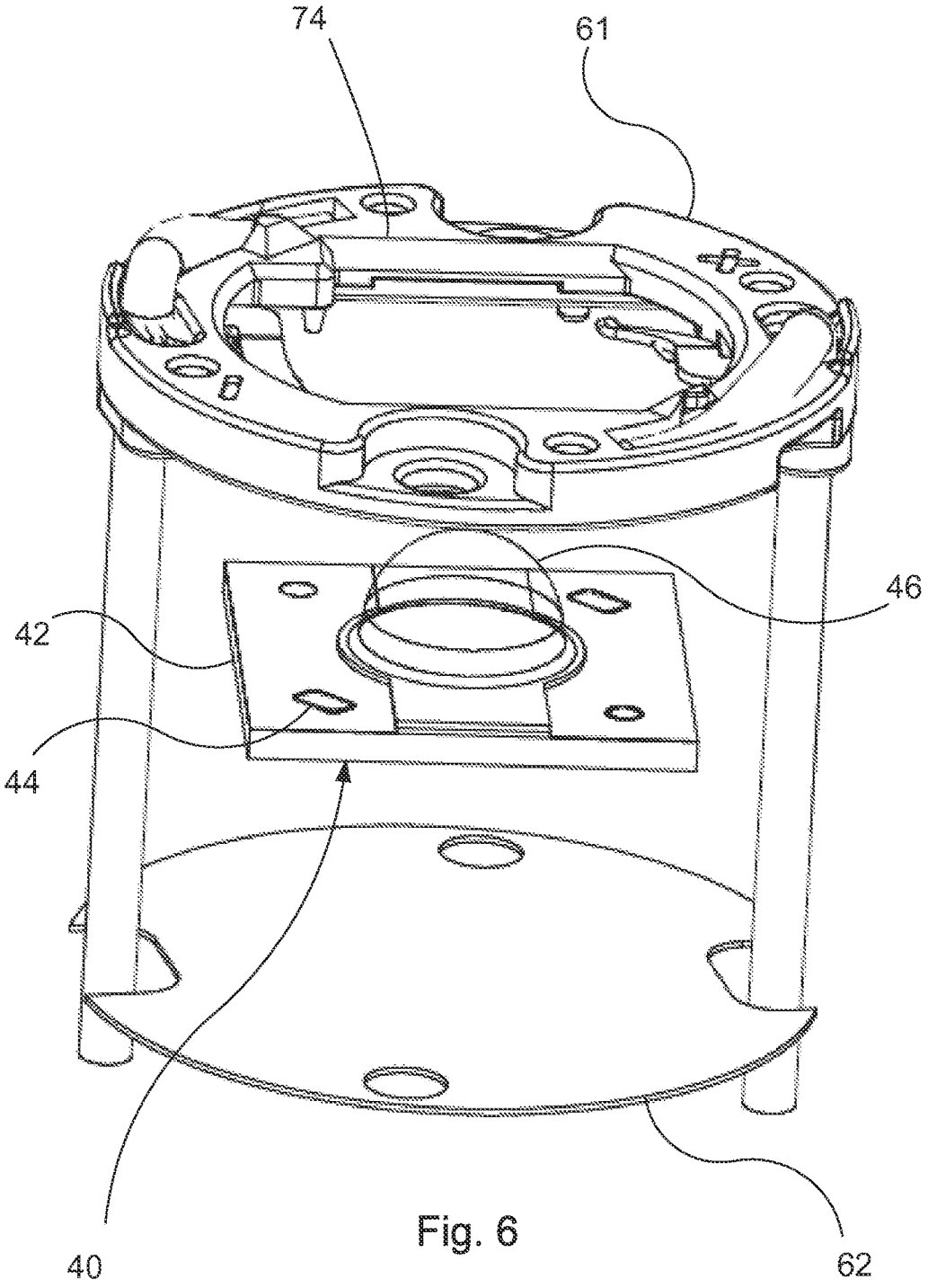
FIG. 6 illustrates a partially exploded view of an exemplary embodiment of a holder and LED array.
Figure 7:
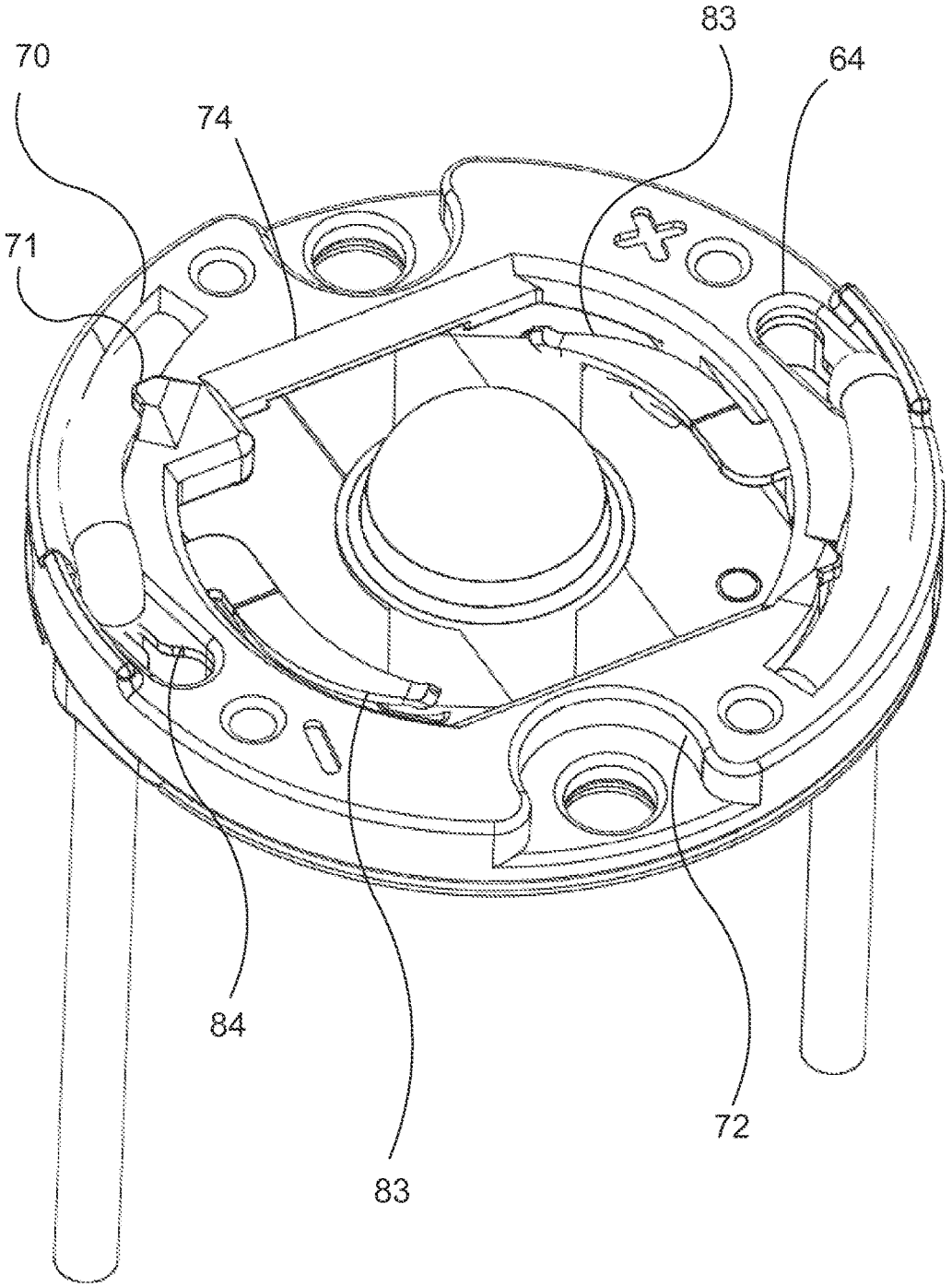
FIG. 7 illustrates a perspective view of an exemplary embodiment of a holder and LED array.
Figure 8:
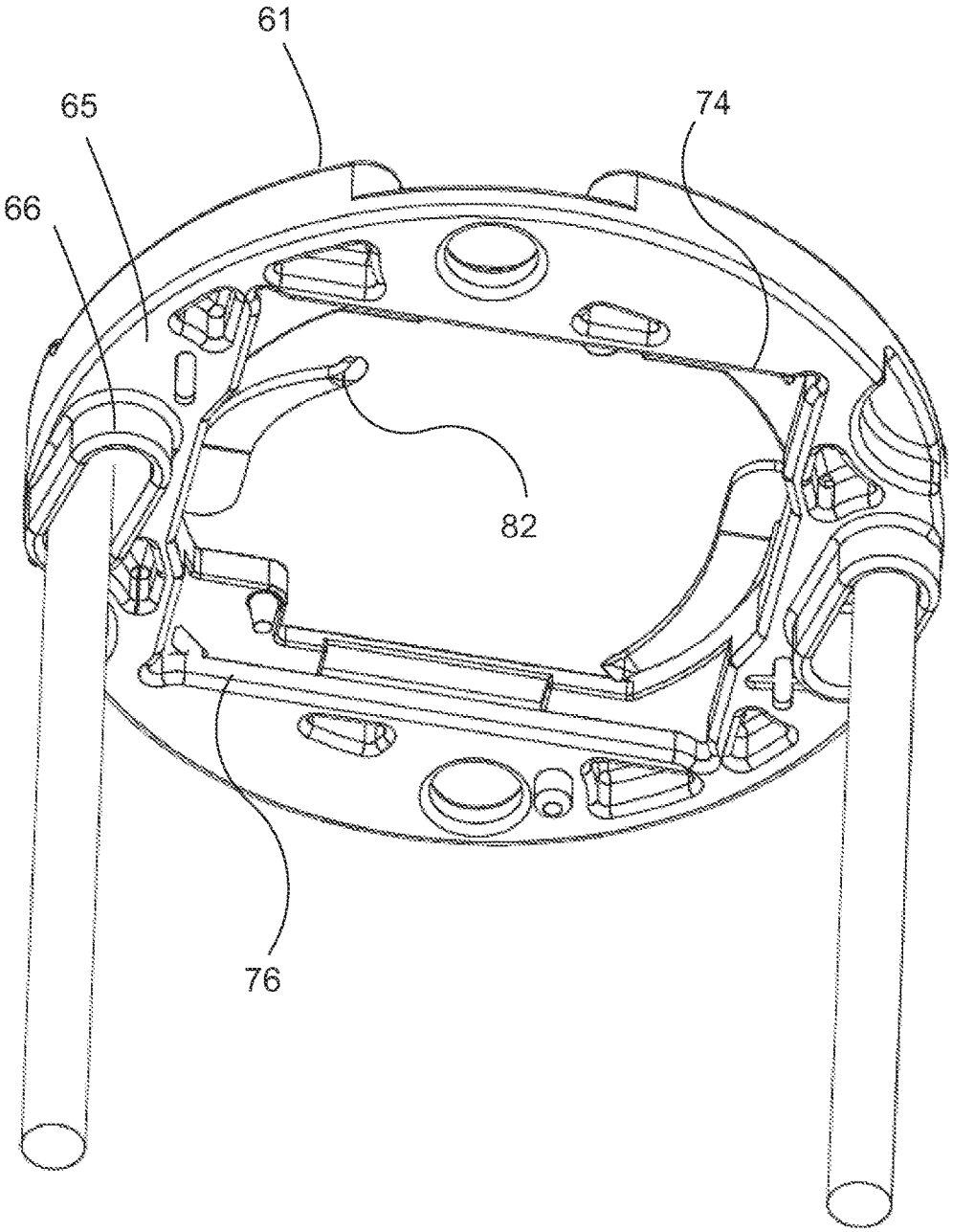
FIG. 8 illustrates a perspective view of an exemplary embodiment of a holder with conductors attached.
Figure 9:
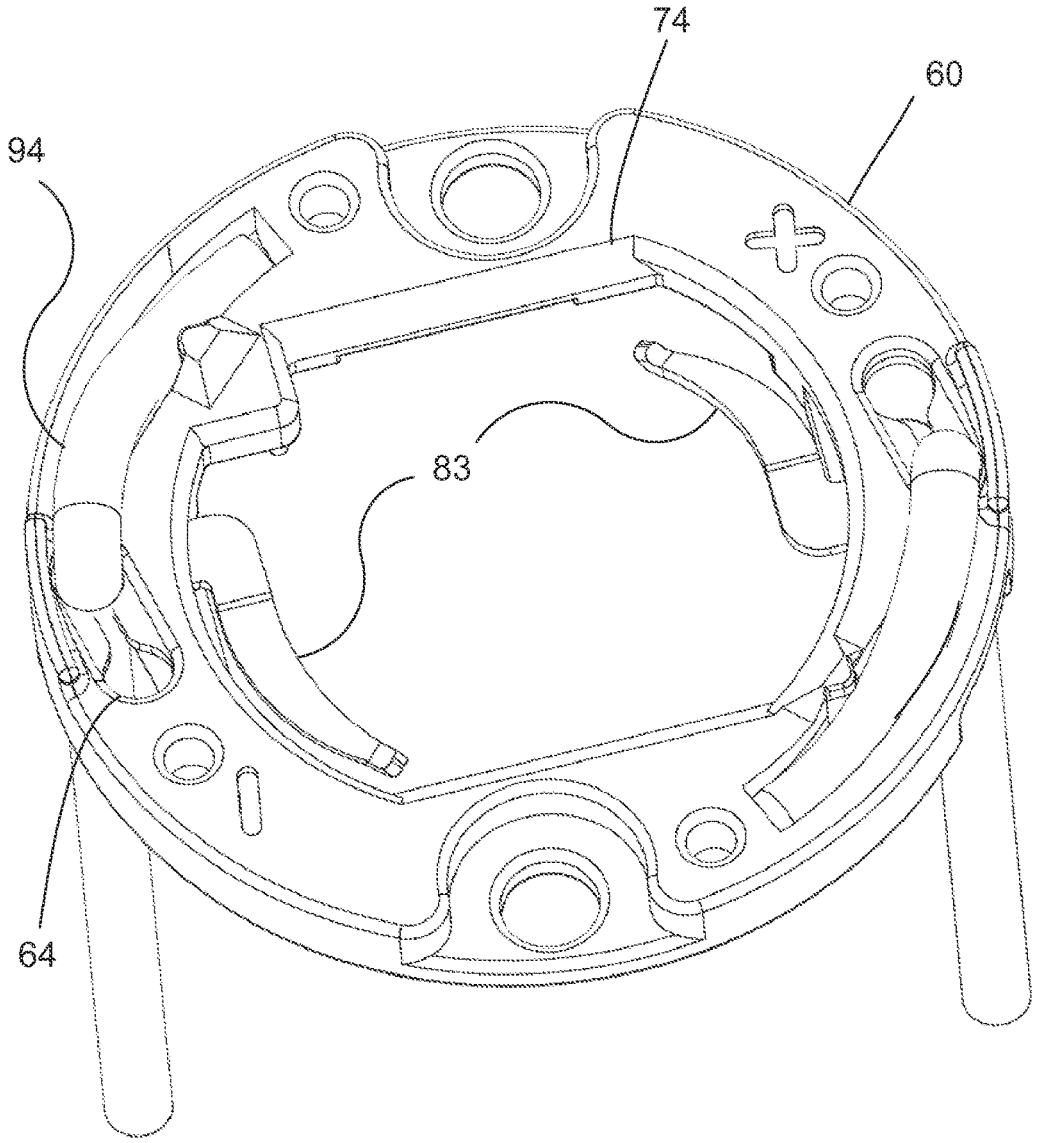
FIG. 9 illustrates a perspective view of an exemplary embodiment of a holder with conductors attached.
Figure 10:
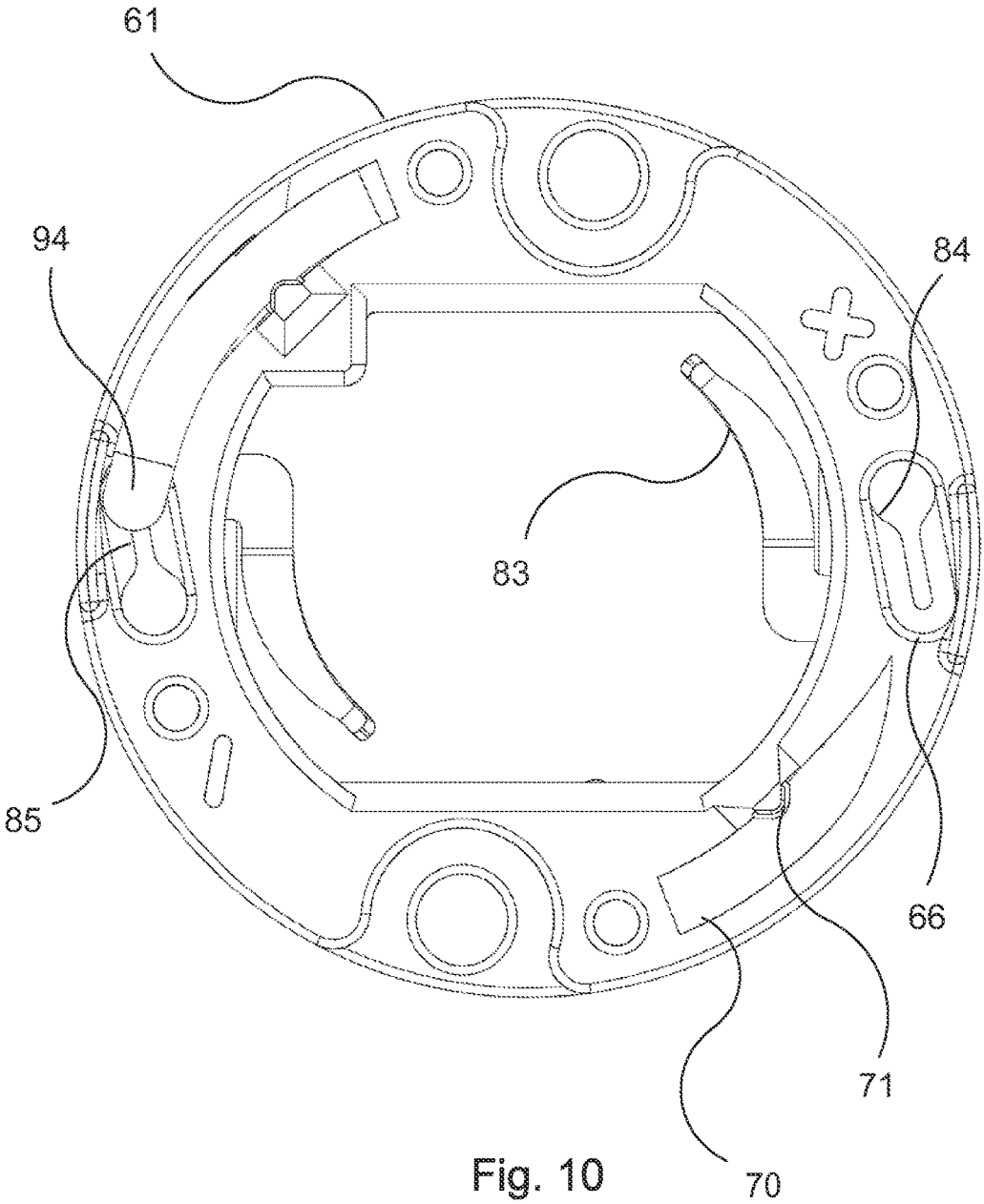
FIG. 10 illustrates a plan view of an exemplary embodiment a holder.
Figure 11:
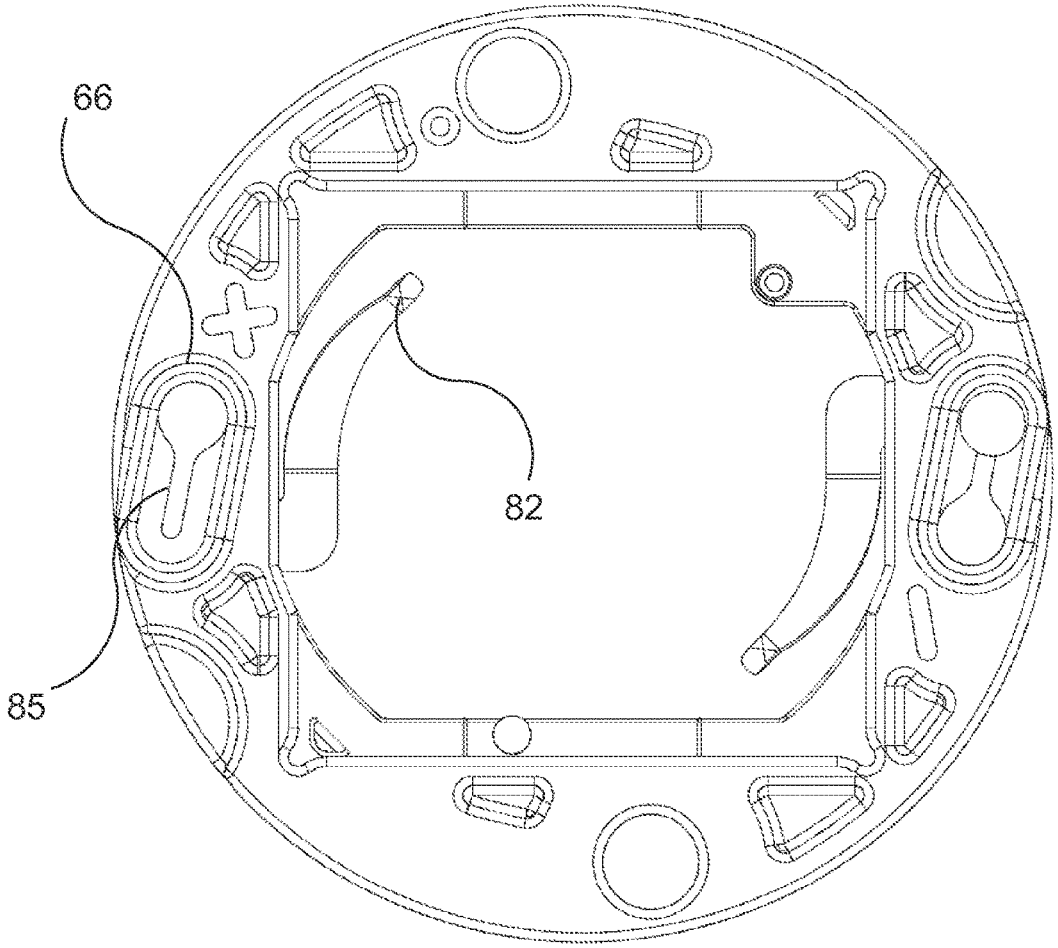
FIG. 11 illustrates a bottom view of an exemplary embodiment of a holder.
Figure 12:
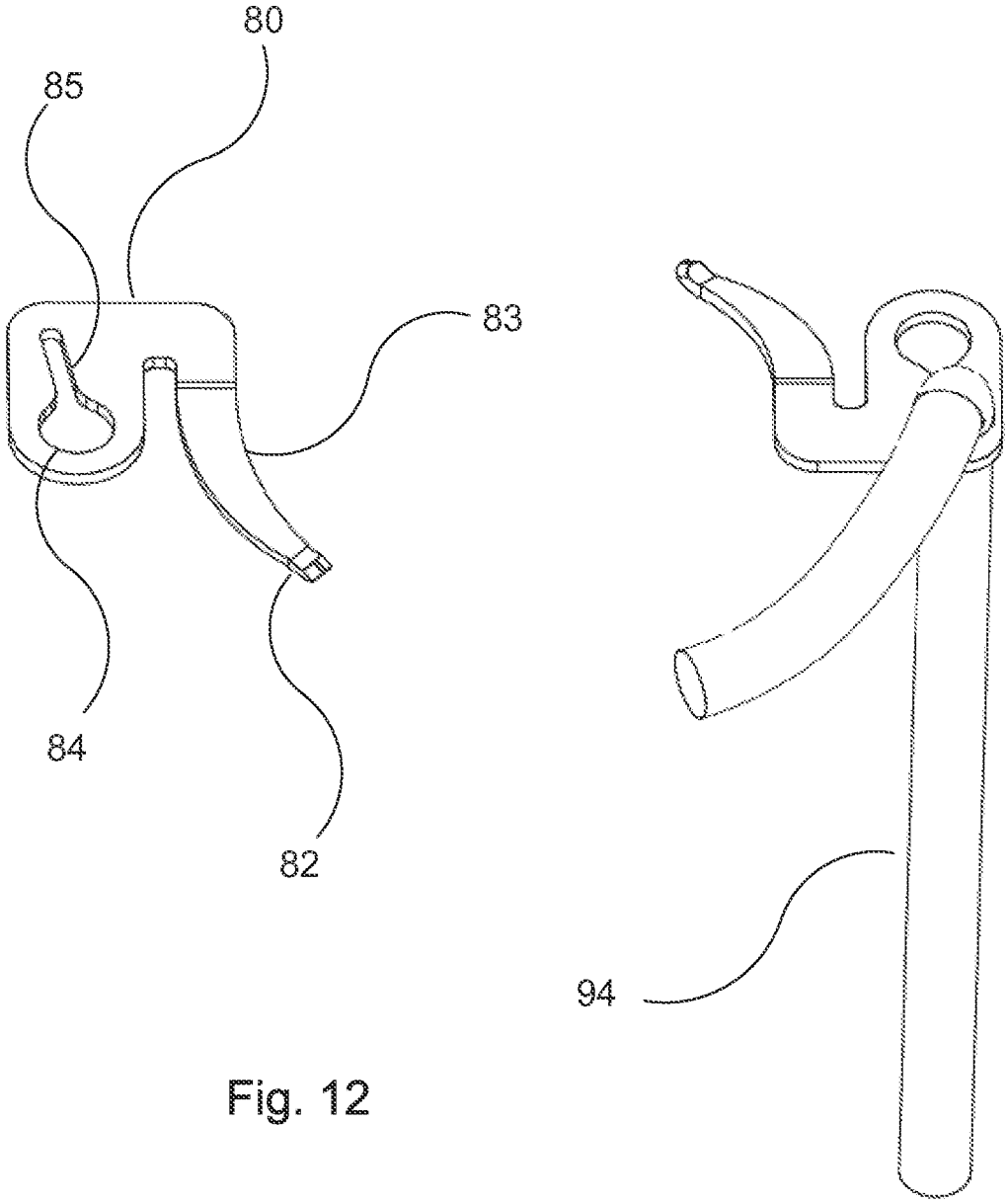
FIG. 12 illustrates a perspective view of exemplary embodiment of terminals suitable for use in a holder.
Figure 13:
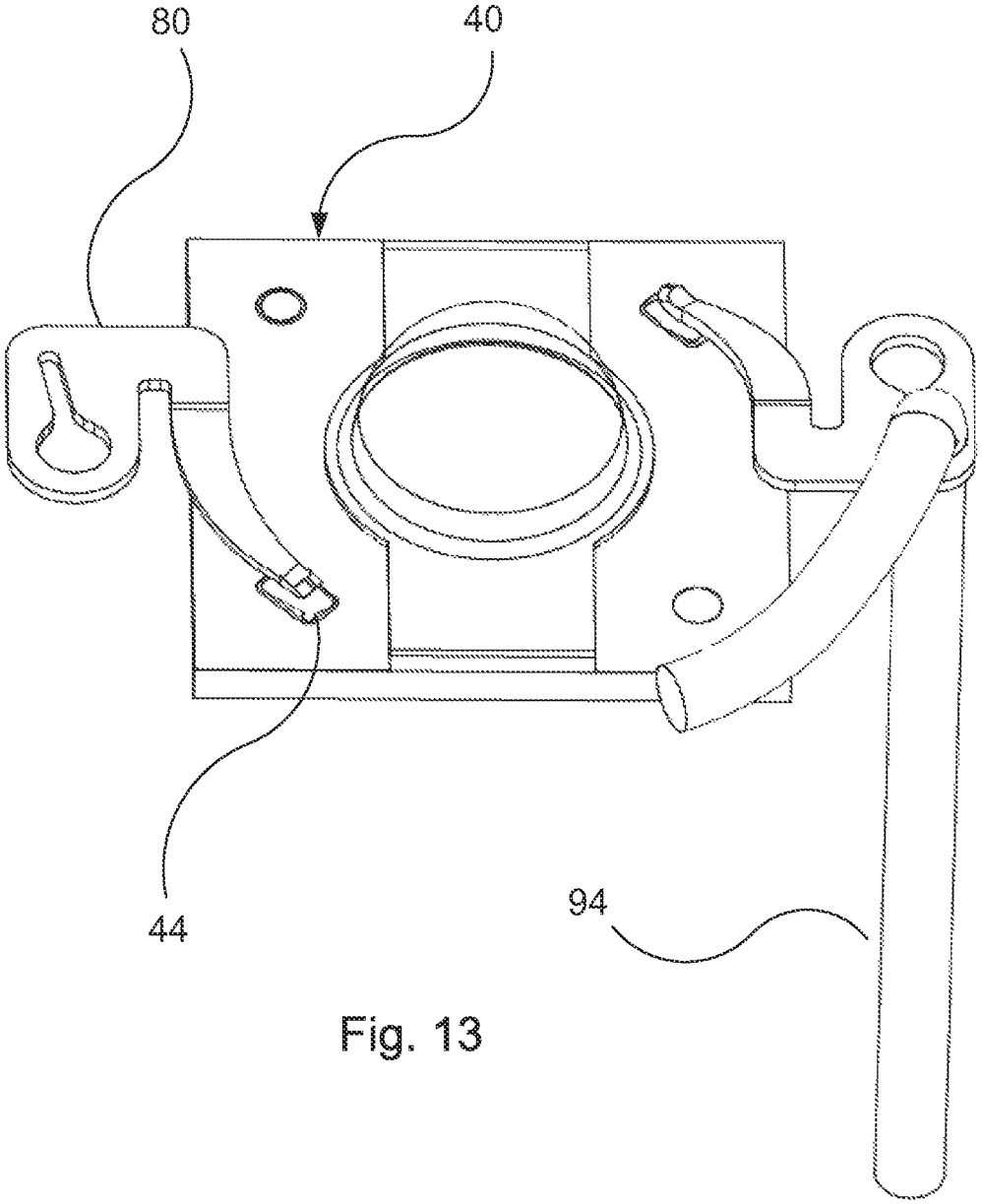
FIG. 13 illustrates a perspective view of the terminals depicted in FIG. 12 engaging an LED array.
Figure 14:
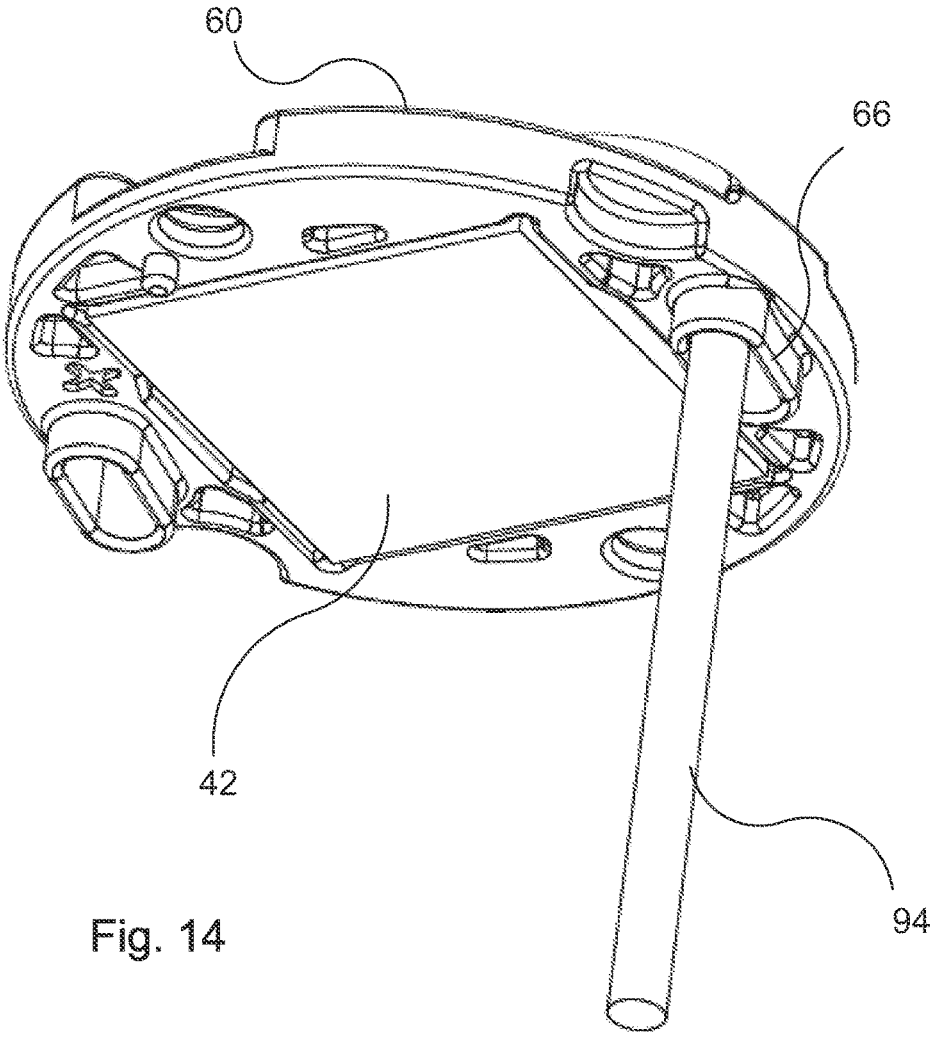
FIG. 14 illustrates a perspective view of an exemplary embodiment of a holder and LED array.
Figure 15:
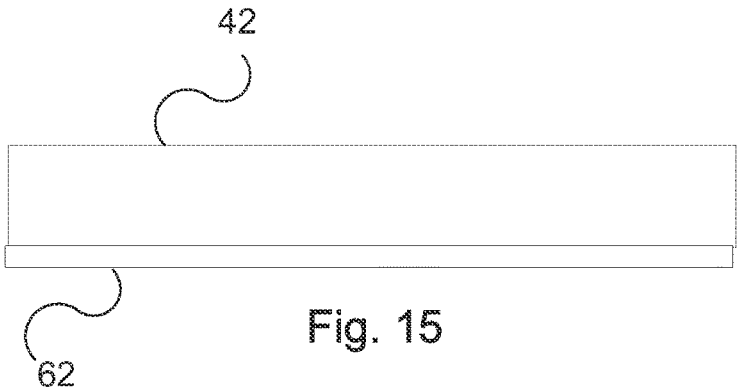
FIG. 15 illustrates a cross-section of a LED array substrate and a thermal pad.

An embodiment of a light emitting display (LED) module 10 is illustrated in FIG. 1. As can be appreciated from FIGS. 1-15, certain features can be provided that allow the LED module 10 to have desirable thermal performance (which is relatively helpful if the LED is to provide a long life) while providing an easy to assemble design. Specifically, a holder 60 is configured to secure an LED array 40 to a housing 20 and the housing 20 can provide heat spreader functionality while the holder 60 provides an electrical connection to contact pads 44 on the LED array 40.

As depicted, the housing 20 can be formed of a conductive material such as a die cast metal or other some other thermally conductive material. It is expected that due to costs and the desired thermal properties, the housing will be both thermally and electrically conductive. The housing 20 includes a floor 22 that supports the holder 60 and LED array 40 and further includes a wall 21 that extends from the floor 22 so as to provide an enclosure 24. To allow for conductors to enter into the enclosure, a channel 23 is provided. As depicted, two small channels are provided but in alternative embodiments the two channels could be combined so as to provide a single channel. Such a construction would be beneficial if the terminals were located closer together instead of on opposing sides of the LED aperture (as depicted). It should also be noted that an inner surface 21*a* of wall 21 can be angled so as to improve light distribution. In an embodiment the holder 60 (or at least a surface of it) can be formed of a highly reflective material (more than 85% reflective) no as to improve efficiency of the corresponding system. This could be accomplished by using a coating or with the use of a reflective material, as desired.

The holder 60 can include one or More fastener mounts 72 that receive a fastener 37 (which secures the holder 60 to the housing 20). As can be appreciated, the housing 20 can include threaded opening configured to receive the fastener 37.

The depicted holder 60 has a base 61 that is formed of an insulative material and includes the LED aperture 74 that receives and holds the LED array 40 in position. A shoulder 76 can help secure the LED array in the LED aperture 74. The base 61 further includes one or more conductor apertures 64 which may include a lip 66 that extends below a support surface 65. As can be appreciated from FIG. 4, for example, the lip 66 extends below the support surface 65 and at least partially through the floor 22. If desired the lip 66 can extend through the floor 22 so as to provide additional electrical isolation. To provide power to the LED array 40, the holder 60 includes two terminals 80 (although some other number of terminals can be provided). Each terminal 80 includes an arm 83 that extends into an LED aperture 74 and supports a contact 82 on a distal end of the arm 83.

The LED array 40 includes a substrate 42 that supports a light engine 46 (which can include one or more LED chips and a phosphorous covering, as is known in the art) and includes a first and second contact pad 44 that are used to provide power to the LED array. Naturally, additional contact pads 44 can be provided if more than one electrical path is provided on LED array (or if the LED array includes a controller and can benefit from a signal input in addition to a power input). The contacts 82 on a distal end of the arms 83 are electrically connected to contact pad 44 when the holder 60 secures the LED array 40 in the desired position.

To improve thermal performance, a thermal pad (can be provided so that the terminal resistance between the LED array 40 and a supporting surface is reduced. Naturally, a thermal paste could also be used if desired. The benefit of a thermal pad 62 is that the thermal pad is cleaner from a manufacturing standpoint and tends to avoid migration of thermal paste that is possible when the thermal paste is under pressure and subject to numerous thermal cycles.

Typically conductors are mated to the terminals via solder or a wire trap. Using solder obviously requires a reflow operation, which can be problematic. A wire trap avoids those issues but tends to work best with solid wires and may be difficult to use with small multi-strand conductors.

To address this, as can be appreciated, the terminals 80 have an opening 84 in communication with an insulation displacement portion (IDP) 85 that allows an insulated conductor to be electrically connected to a terminal 80 without the need for any soldering. Thus, a conductor can be inserted through the opening 84, pressed into the IDP 85 and electrically connected to the terminal 80 in a reliable and cost-effective manner. This has been determined to provide a more friendly manufacturing process that is more suitable to locations where the LED module is assembled (e.g., in a manufacturing processes where a reflow operation are undesirable). Thus, compared to existing solutions, a holder 60 can provide both the electrical connection to an LED array 40 while also providing the electrical connection to conductors 94, all without requiring soldering.

To help provide improved performance, the base 61 can also include a retaining well 70 that can act to prevent the conductor 94 from accidentally shorting to an undesirable component during high-voltage testing. A securing finger 71 can be provided to secure the conductor 94 in the retaining well 70. In an embodiment the well can be more than 5 mm and potentially at least 10 men long so as to allow for ease of mating to the IDP 85 of the terminals 80. Thus, compared to existing designs, the depicted embodiments allow for a simple to manufacture holder 60 that can assist in the passing of various requirements such as UL compliance.

Figure 16:
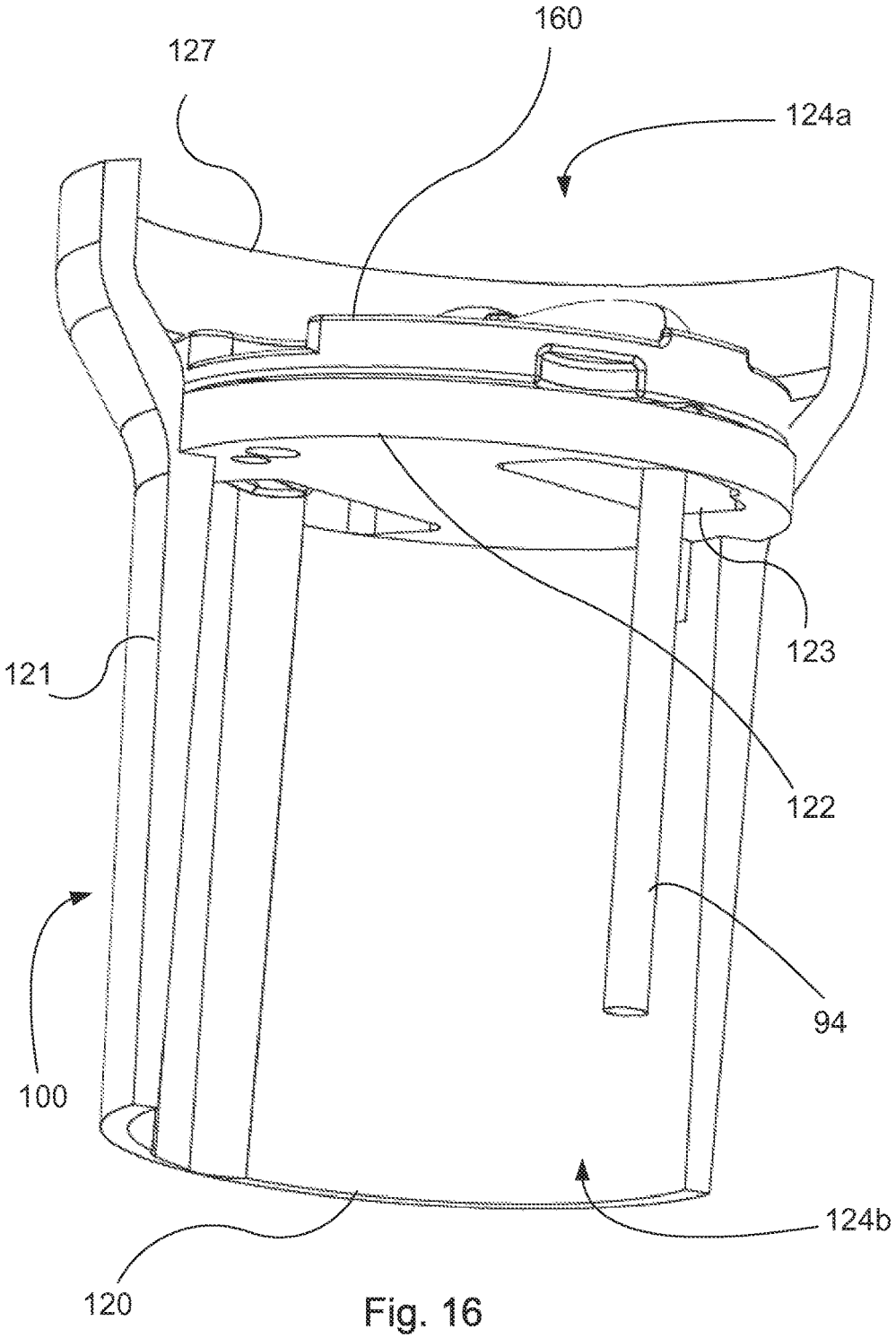
FIG. 16 illustrates a perspective partially cut-away view of an exemplary embodiment of a LED module.
Figure 17:
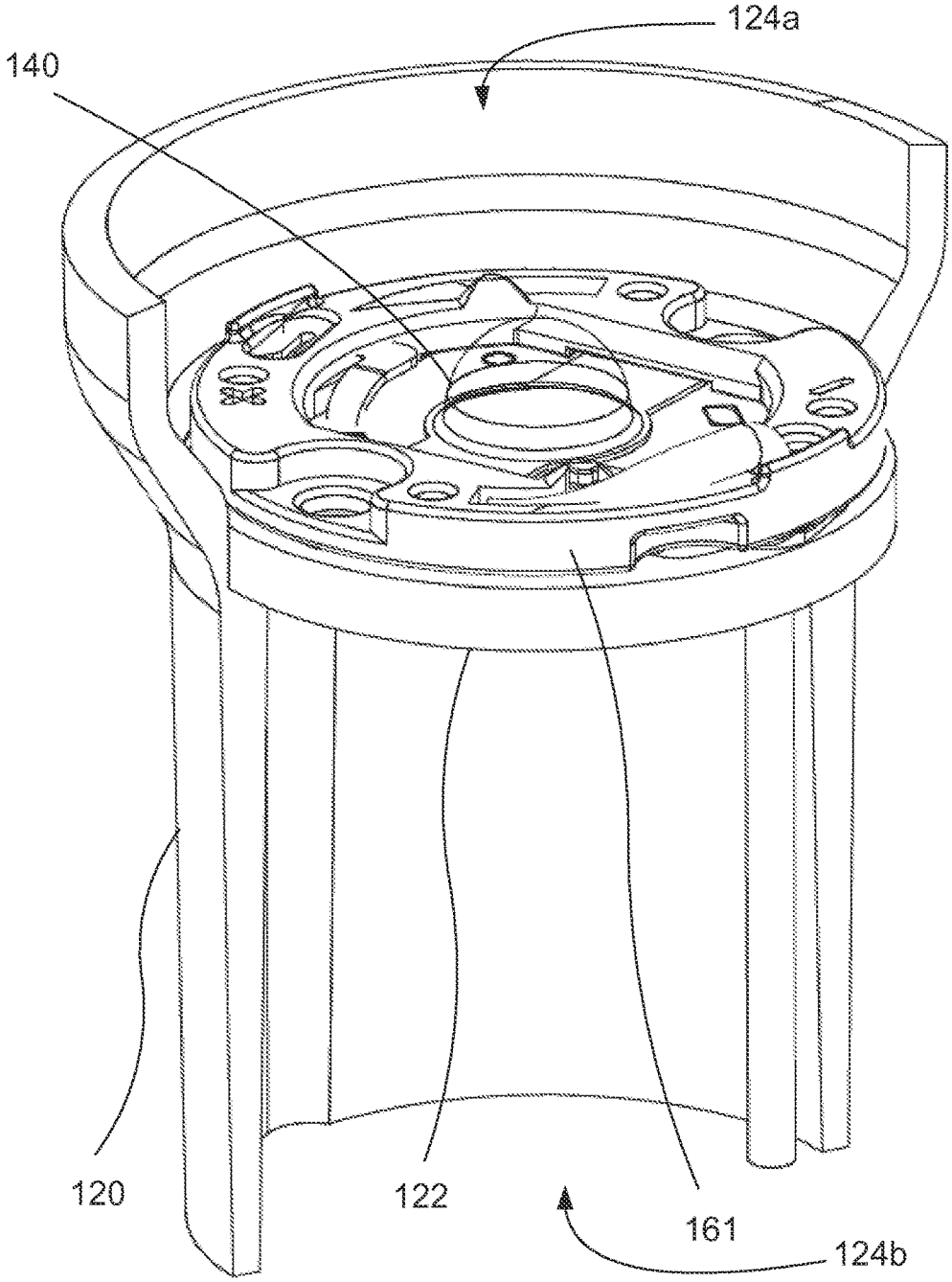
FIG. 17 illustrates another perspective view of the LED module depicted in FIG. 16.

FIGS. 16-17 illustrate a partially cut-away (for purposes of illustration) embodiment where an LED module 100 includes a housing 120 that can act as a heat spreader and a heat sink. The housing 120 could be configured as a single piece or could be several pieces coupled together. The housing 120 could support a power supply that would be useful in converting power from, for example, AC to DC. As can be appreciated, the AC could be line voltage or some other voltage (such as 12 VAC) and could be potted in an appropriate manner if desired. In alternative embodiments, the power supply might not convert the AC to DC but instead provide filtered AC directly to the LED array.

More specifically, the housing 120 includes a floor 122 with a wall 121 that extends above and below the floor 122 so as to provide a first enclosure **124*a* and a second enclosure 124*b*. A holder 160 is position on the floor 122 and supports an LED array 140. As can be appreciated, the holder 160 and LED array 140 can be configured as discussed above. This allows conductors to extend from the second enclosure, through the floor 122, through a base 161 of the holder 160** and be connected to terminals in the first enclosure in a manner as discussed above.

One feature that may be discerned is that the terminal is relative low profile. This allows the LED to be placed more close to the surface of the LED. Consequentially it is possible to provide wider beam angles than might otherwise be possible in a given size for a particular lens type.

As can be appreciated, an optic may be provided on the LED module, which is depicted as having an edge 127. Thus, an optic could be mounted on the edge 127 if desired. In certain embodiments the optic may shape light into a desirable beam angle (such as 15 degrees, 30 degrees or the like) with the use of one or more lenses and/or reflectors. In alternative embodiments the optic could be more of a cover that provides minimal lumen loss while acting to shield the LED array from dust and other undesirable external conditions and may provide only minimal light shaping.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A holder, comprising:

a base with an LED aperture and a support surface and a first conductor aperture and a second conductor aperture, wherein the first conductor aperture and the second conductor aperture each include a lip that extends below the support surface;

a first terminal having a first opening in communication with an insulation displacement portion (IDP) aligned with the first conductor aperture, the first opening for inserting a first conductor therethrough and the IDP for providing electrical connection between the first conductor and the first terminal when the first conductor is pressed into the IDP, the first terminal including an arm that extends into the LED aperture, the arm including a contact on a distal end; and a second terminal having a second opening in communication with an IDP aligned with the second conductor aperture, the second opening for inserting a second conductor therethrough and the IDP for providing electrical connection between the second conductor and the second terminal when the second conductor is pressed into the IDP, the second terminal including an arm that extends into the LED aperture, the arm including a contact on a distal end.

2. The holder of claim 1, wherein base includes at least fastener mount.

3. The holder of claim 1, wherein the terminals are positioned on opposing sides of the LED aperture.

4. The holder of claim 1, wherein the holder includes a conductor groove configured to receive an end of a conductor positioned in the IDP.

5. The holder of claim 4, wherein the conductor groove extends in a curved manner and is about 10 mm long.

6. An LED module, comprising:

a holder with a base that includes an LED aperture and a support surface and a first conductor aperture and a second conductor aperture, wherein the first conductor aperture and the second conductor aperture each include a lip that extends below the support surface, the holder further including a first terminal having a first opening in communication with an insulation displacement portion (IDP) aligned with the first conductor aperture, the first opening for inserting a first conductor therethrough and the IDP for providing electrical connection between the first conductor and the first terminal when the first conductor is pressed into the IDP, the first terminal including an arm that extends into the LED aperture, the arm including a contact on a distal end and a second terminal having a second opening in communication with an IDP aligned with the second conductor aperture, the second opening for inserting a second conductor therethrough and the IDP for providing electrical connection between the second conductor and the second terminal when the second conductor is pressed into the IDP, the second terminal including an arm that extends into the LED aperture, the arm including a contact on a distal end;

an LED array with a substrate that supports a light engine and a first contact pad and a second contact pad, the contact on the first terminal connected to the first contact pad and the contact on the second terminal connected to the second contact pad;

a housing configured to conduct thermal energy from the LED array, the housing having a floor supporting the support surface and further including a wall that extends from the floor so as to provide a first enclosure that raises above the base, wherein the floor includes at least one channel aligned with the first and second conductor apertures and the lips of the first and second conductor apertures extend at least partially through the floor.

7. The LED module of claim 6, wherein the lips extends through the floor.

8. The LED module of claim 6, further including a thermal pad positioned between the LED array and the floor.

9. The LED module of claim 6, wherein the holder includes a fastener mount and the housing includes a threaded opening, the LED module further comprising a screw securing the holder to the housing.

10. The LED module of claim 6, wherein the wall extends on two sides of the floor so at to provide the first enclosure above the floor and to further provide a second enclosure below the floor.

11. The LED module of claim 6, wherein the housing is made of a die-cast metal.

* * * * *